US012623279B1

(12) United States Patent
Shaber et al.

(10) Patent No.: US 12,623,279 B1
(45) Date of Patent: May 12, 2026

(54) SYSTEM, APPARATUS, AND METHOD FOR PROVIDING CASTING GAS IN A DIRECT CHILL CASTING MOLD

(71) Applicant: WAGSTAFF, INC., Spokane Valley, WA (US)

(72) Inventors: Nicholas Shaber, Post Falls, ID (US); Brett Thielman, Spokane Valley, WA (US)

(73) Assignee: WAGSTAFF, INC., Spokane Valley, WA (US)

( * ) Notice: Subject to any disclaimer, the term of this patent is extended or adjusted under 35 U.S.C. 154(b) by 0 days.

(21) Appl. No.: 19/233,740

(22) Filed: Jun. 10, 2025

(51) Int. Cl.
*B22D 11/20* (2006.01)
*B22D 11/049* (2006.01)

(52) U.S. Cl.
CPC ..... *B22D 11/20* (2013.01); *B22D 11/049* (2013.01)

(58) Field of Classification Search
CPC ..... B22D 11/049; B22D 11/20
USPC ..... 164/455, 444, 487
See application file for complete search history.

(56) References Cited

U.S. PATENT DOCUMENTS 5,431,213 A 7/1995 Jouet-Pastre
5,873,405 A 2/1999 Carrier et al.
6,016,940 A * 1/2000 Florent et al. ..... B22D 41/58 222/603

* cited by examiner

*Primary Examiner* — Kevin P Kerns
(74) *Attorney, Agent, or Firm* — ALSTON & BIRD LLP

(57) ABSTRACT

Provided herein is a system, apparatus, and method for providing casting gas to a direct chill casting mold, and more particularly, to supplying casting gas to a direct chill casting mold at a well-regulated pressure and volume using fluid injectors. Systems for supplying casting gas to a continuous casting mold can include: a continuous casting mold cavity; a casting gas supply line; an injector receiving casting gas from the casting gas supply line; and a post injector casting gas supply line, where the casting gas supply line provides casting gas at a pressure above 300 psi (pounds per square inch) to an input of the injector, where a controller controls the injector to supply casting gas via the post injector casting gas supply line to the continuous casting mold cavity.

20 Claims, 11 Drawing Sheets

SYSTEM, APPARATUS, AND METHOD FOR PROVIDING CASTING GAS IN A DIRECT CHILL CASTING MOLD

TECHNOLOGICAL FIELD

The present disclosure relates to a system, apparatus, and method for providing casting gas to a direct chill casting mold, and more particularly, to supplying casting gas to a direct chill casting mold at a well-regulated pressure and volume using fluid injectors.

BACKGROUND

Metal products are formed in a variety of ways; however numerous forming methods first require an ingot, billet, or other cast part that can serve as the raw material from which a metal end product can be manufactured, such as through rolling, extrusion, or machining, for example. One method of manufacturing an ingot or billet is through a continuous casting process also known as direct chill casting, whereby a vertically oriented mold cavity is situated above a platform that translates vertically down into a casting pit. A starter block may be situated on the platform and form a bottom of the mold cavity, at least initially, to begin the casting process. Molten metal is poured into the mold cavity whereupon the molten metal cools, typically using a cooling fluid. The platform with the starter block thereon descends into the casting pit at a predefined speed to allow the metal exiting the mold cavity and descending with the starter block to solidify. The platform continues to be lowered as more molten metal enters the mold cavity, and solid metal exits the mold cavity. This continuous casting process allows metal ingots and billets to be formed according to the profile of the mold cavity and having a length limited only by the casting pit depth and the hydraulically actuated platform moving therein. To aid in release of the partially solidified metal from the continuous casting mold and to reduce heat transfer from the metal to the mold wall, air may be introduced through the mold walls to create an air barrier that reduces friction and reduces thermal conductivity.

BRIEF SUMMARY

The present disclosure relates to a system, apparatus, and method for providing casting gas to a direct chill casting mold, and more particularly, to supplying casting gas to a direct chill casting mold at a well-regulated pressure and volume using fluid injectors. Embodiments provided herein include a system for supplying casting gas to a continuous casting mold, the system including: a continuous casting mold cavity; a casting gas supply line; a valve receiving casting gas from the casting gas supply line; and a post valve casting gas supply line, where a pressure ratio of a pressure in the casting gas supply line to a pressure in the post valve casting gas supply line is about two-to-one, where a controller controls the valve to supply casting gas via the post injector casting gas supply line to the continuous casting mold cavity using pulsed flow.

According to some embodiments the valve includes an electronically controlled injector. The electronically controlled injector is, in some embodiments, an automotive fuel injector. The system of some embodiments further includes a channel within the continuous casting mold, where the post injector casting gas supply line provides the casting gas to the channel which distributes the casting gas around the continuous casting mold cavity. According to some embodiments the continuous casting mold cavity includes a porous graphite mold wall, where the casting gas is provided to the continuous casting mold cavity through the porous graphite mold wall. The casting gas of an example embodiment includes at least air and a lubricant.

According to certain embodiments the injector includes a solenoid operated valve to open and close the injector, where in an open condition the injector permits flow of casting gas from the casting gas supply line to the post injector casting gas supply line. According to some embodiments the injector includes a fixed orifice for supplying casting gas to the post injector casting gas supply line. According to certain embodiments the injector is driven by the controller using pulse width modulation. The injector of an example embodiment is controlled using an open loop control strategy. According to some embodiments the injector is controlled according to a temperature and a pressure of the casting gas at the casting gas supply line.

Embodiments include a system for supplying casting gas to a continuous casting mold, the system including: a controller; at least one continuous casting mold cavity; a casting gas manifold; at least one injector where each of the at least one injector is associated with a respective one of the at least one continuous casting mold cavity, where the at least one injector receives casting gas from the casting gas manifold and is controlled by the controller to supply casting gas to the respective one of the at least one continuous casting mold cavity.

According to some embodiments the at least one injector comprises a solenoid operated valve to open and close the at least one injector, where in an open condition the at least one injector permits flow of casting gas from a casting gas supply line to a post injector casting gas supply line. According to certain embodiments the at least one injector includes a fixed orifice for supplying casting gas to the post injector casting gas supply line. The at least one injector of an example embodiment is driven by the controller using pulse width modulation.

The system of some embodiments further includes a channel within the continuous casting mold, where the post injector casting gas supply line provides the casting gas to the channel which distributes the casting gas around the at least one continuous casting mold cavity. According to certain embodiments the at least one continuous casting mold cavity includes a porous graphite mold wall, wherein the casting gas is provided to the at least one continuous casting mold cavity through the porous graphite mold wall. According to some embodiments the casting gas comprises at least air and a lubricant. According to certain embodiments the at least one injector is controlled using an open loop control strategy. The at least one injector of an example embodiment is controlled according to a temperature and a pressure of the casting gas at a casting gas supply line.

Embodiments provided herein include a method for supplying casting gas to a continuous casting mold, the method including: providing casting gas at a first pressure and temperature to an inlet of an injector; controlling the injector based, at least in part, on a first temperature and pressure, to open and close the injector; receiving, at a continuous casting mold cavity, the casting gas at a second pressure, where the casting gas is provided to the continuous casting mold cavity through a porous graphite liner of the continuous casting mold. According to some embodiments the casting gas includes at least air and a lubricant.

BRIEF DESCRIPTION OF THE DRAWINGS

Figure 1:
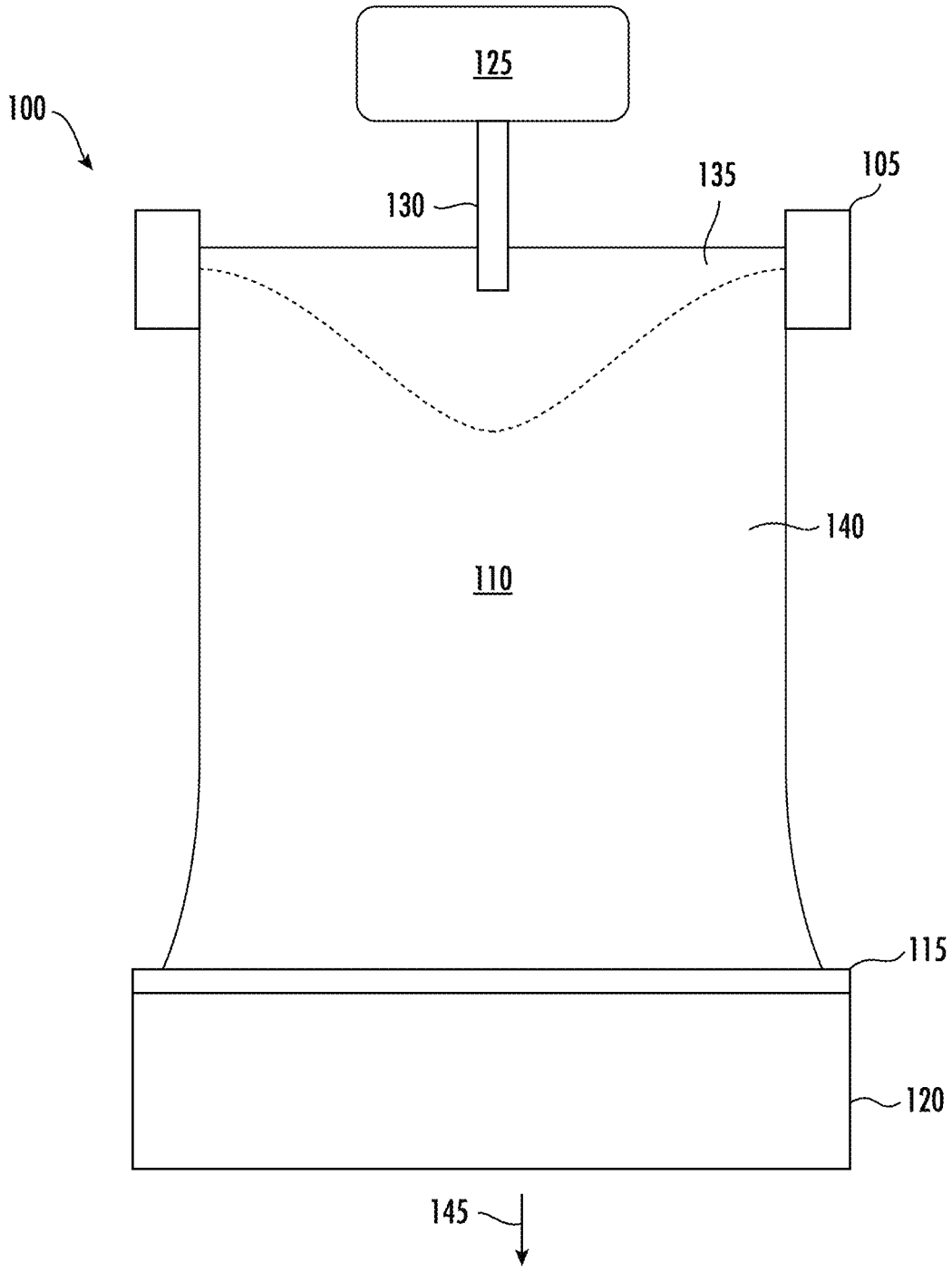
FIG. 1 PRIOR ART
Figure 2:
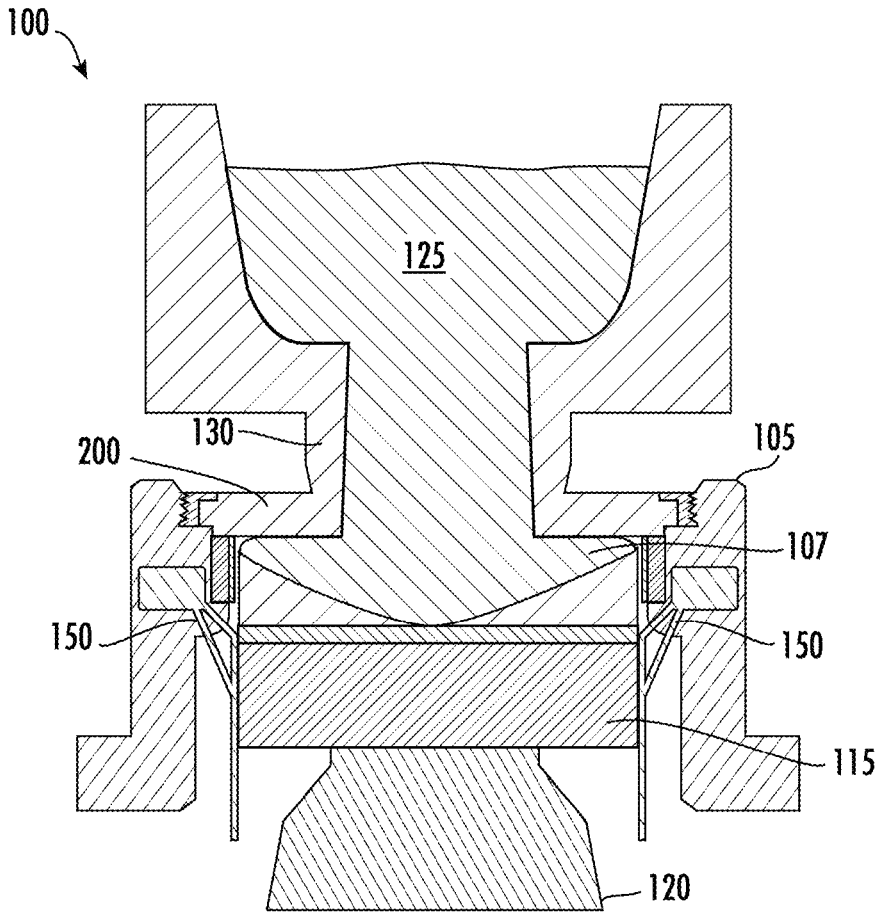
Figure 3:
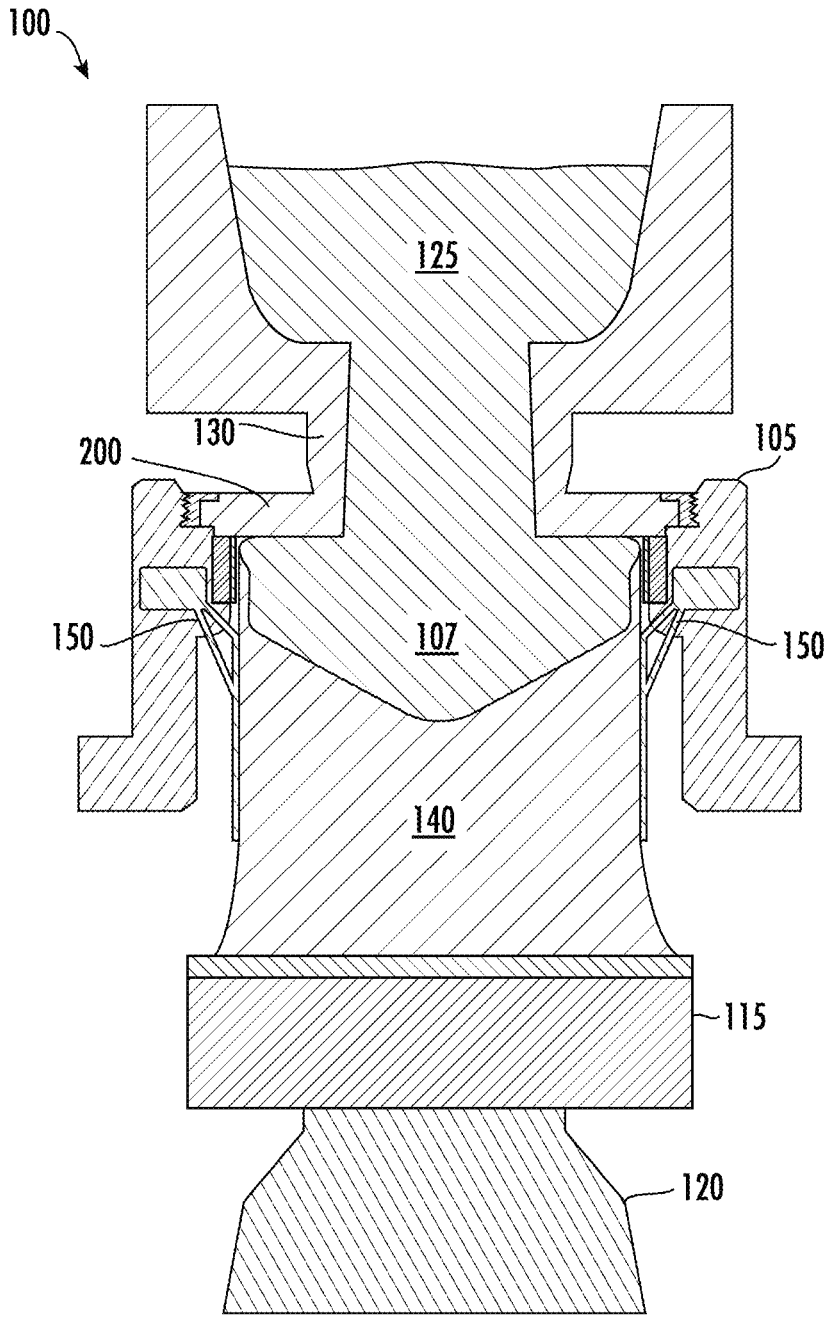
Figure 4:
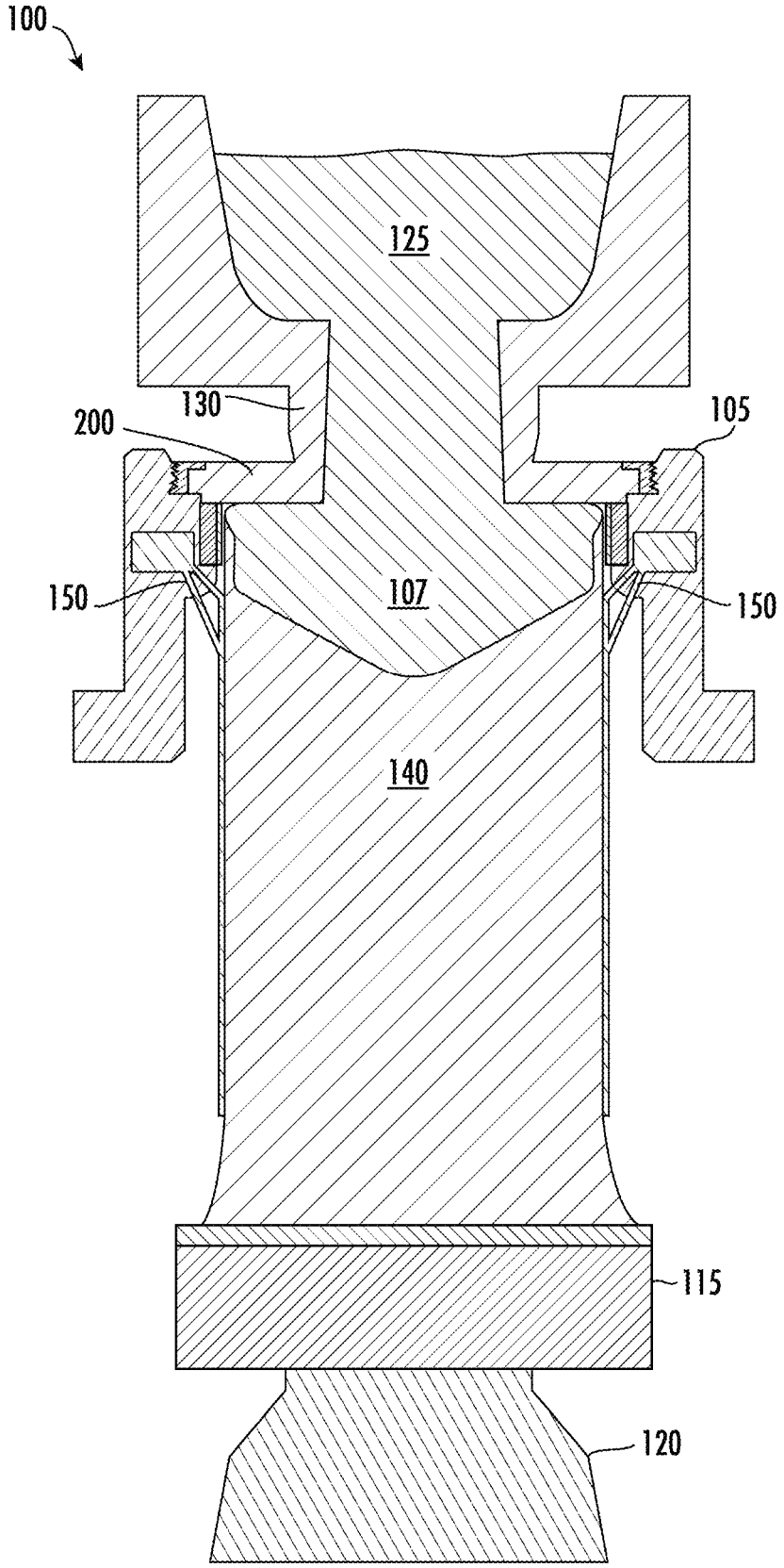
Figure 5:
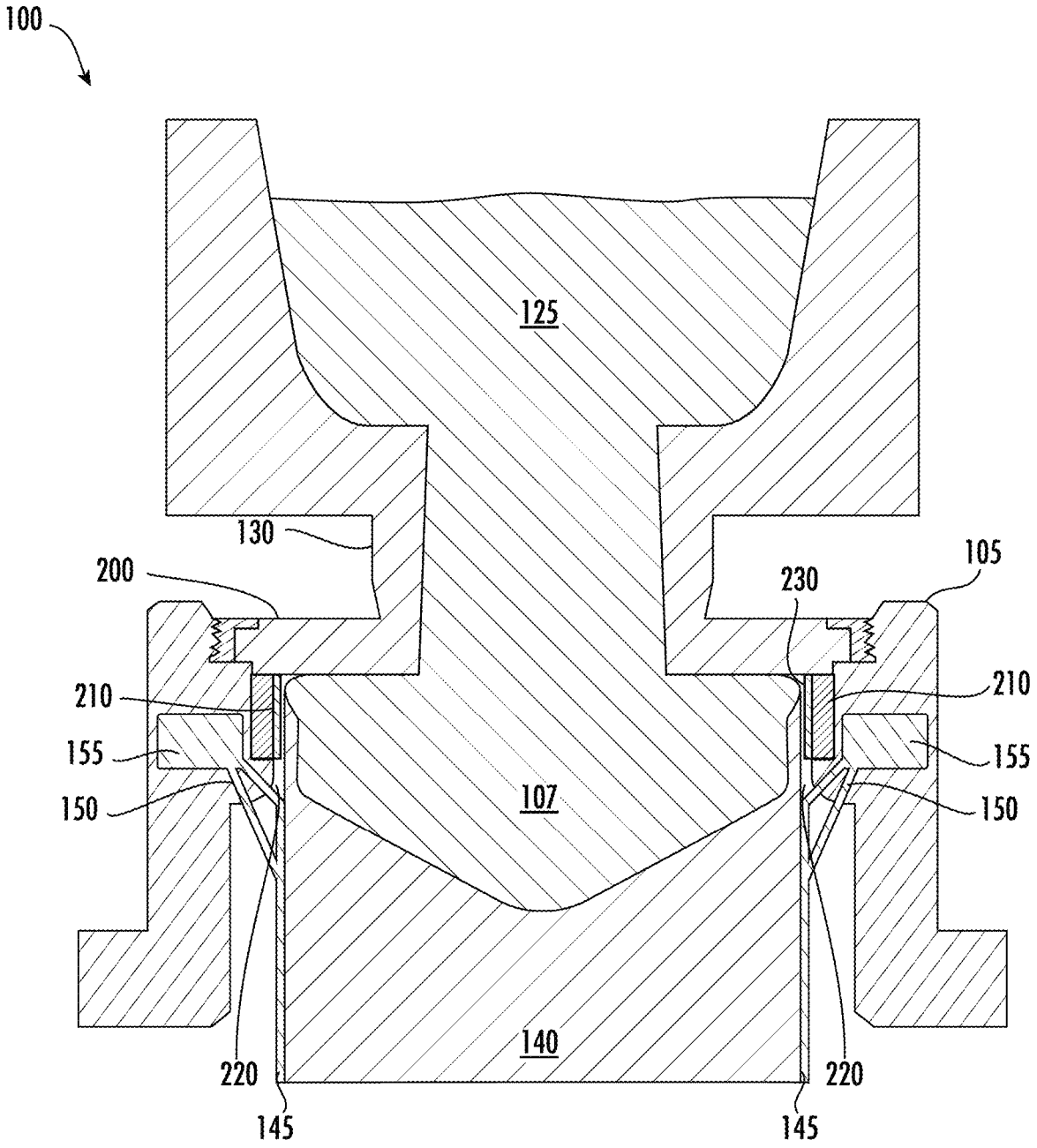
Figure 6:
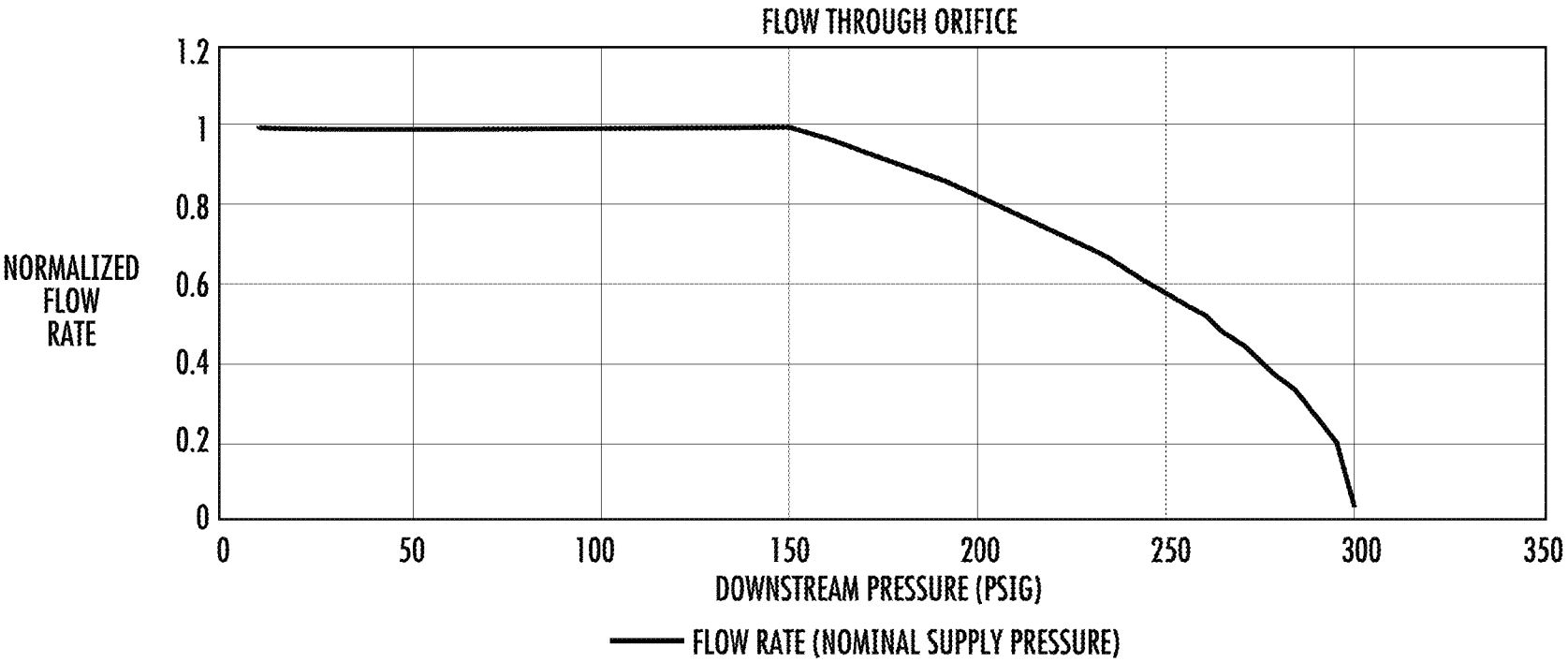
Figure 7:
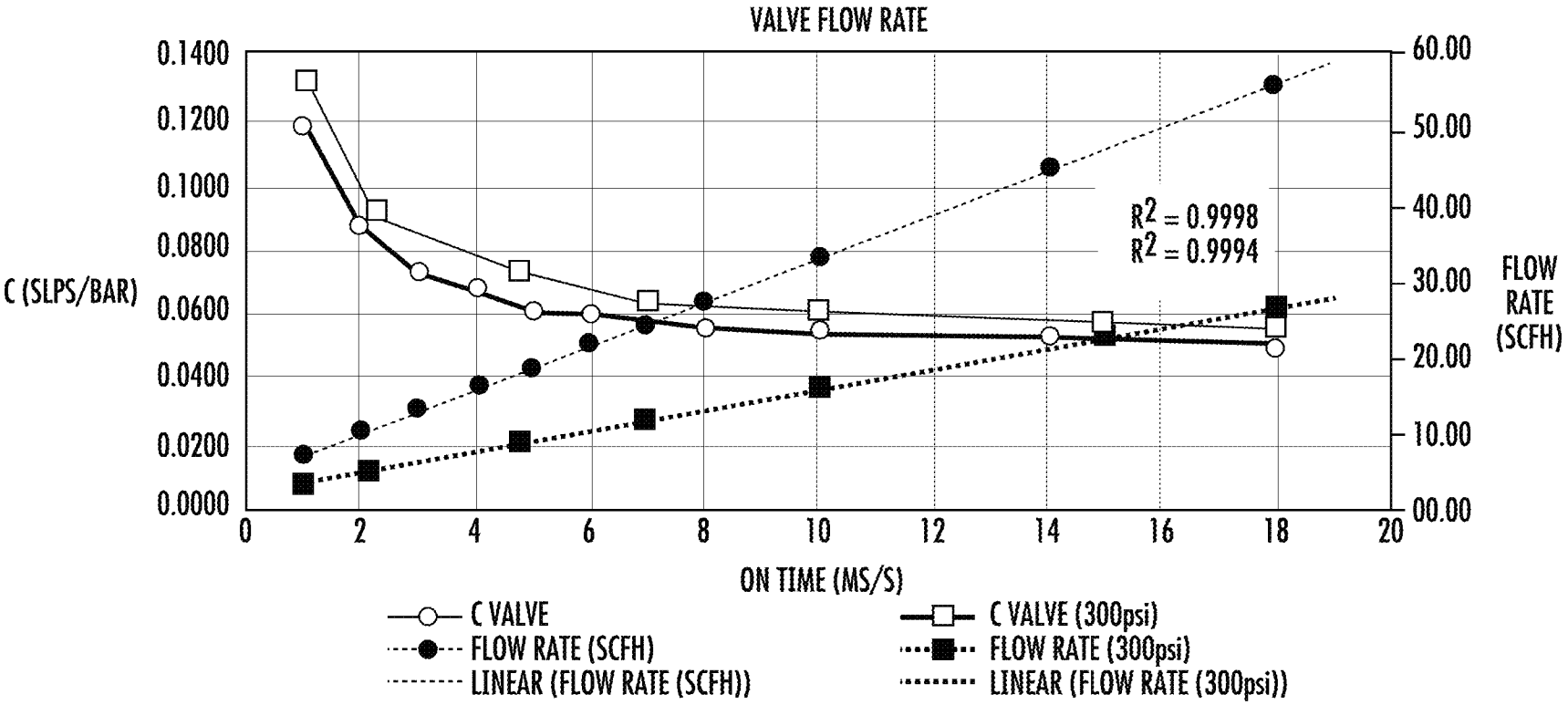
Figure 8:
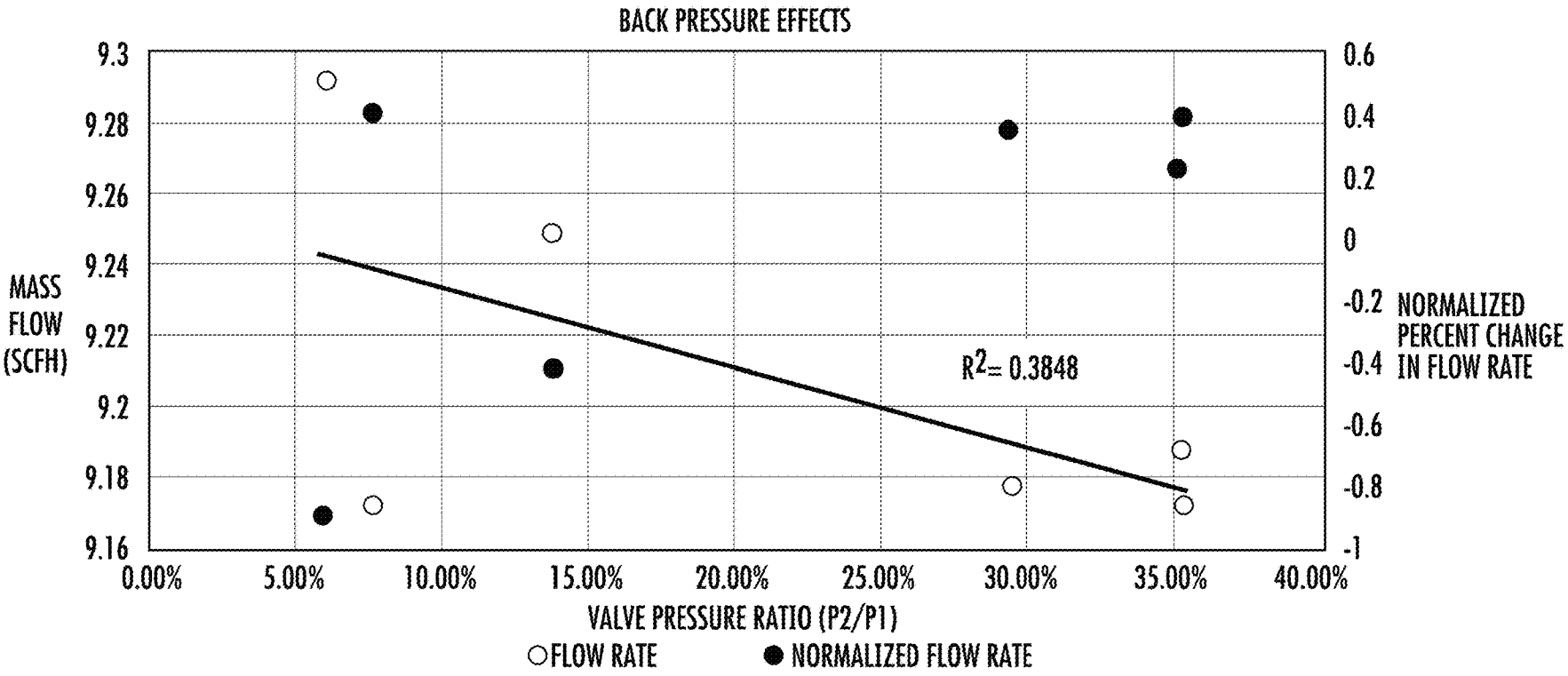
Figure 9:
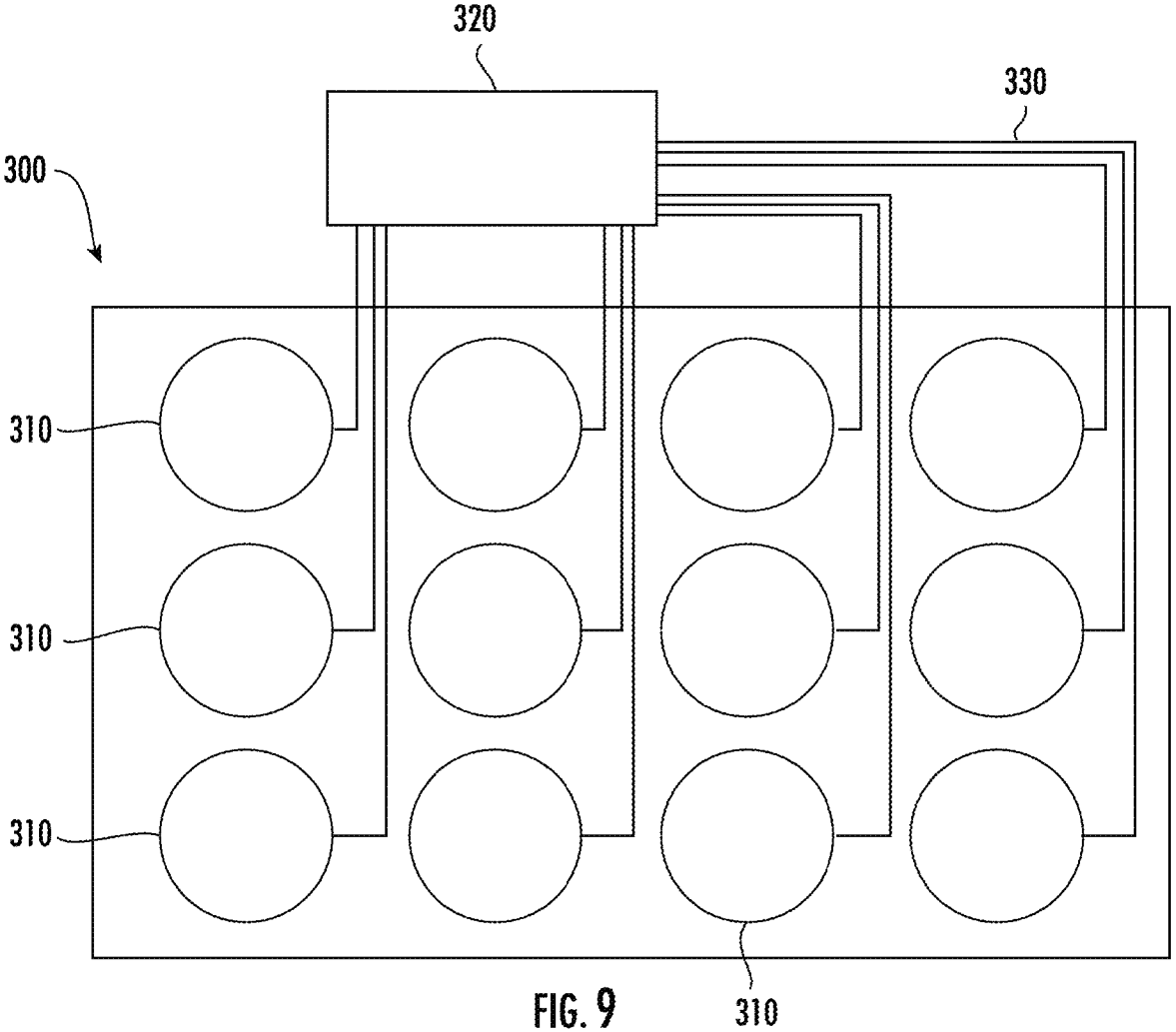
Figure 10:
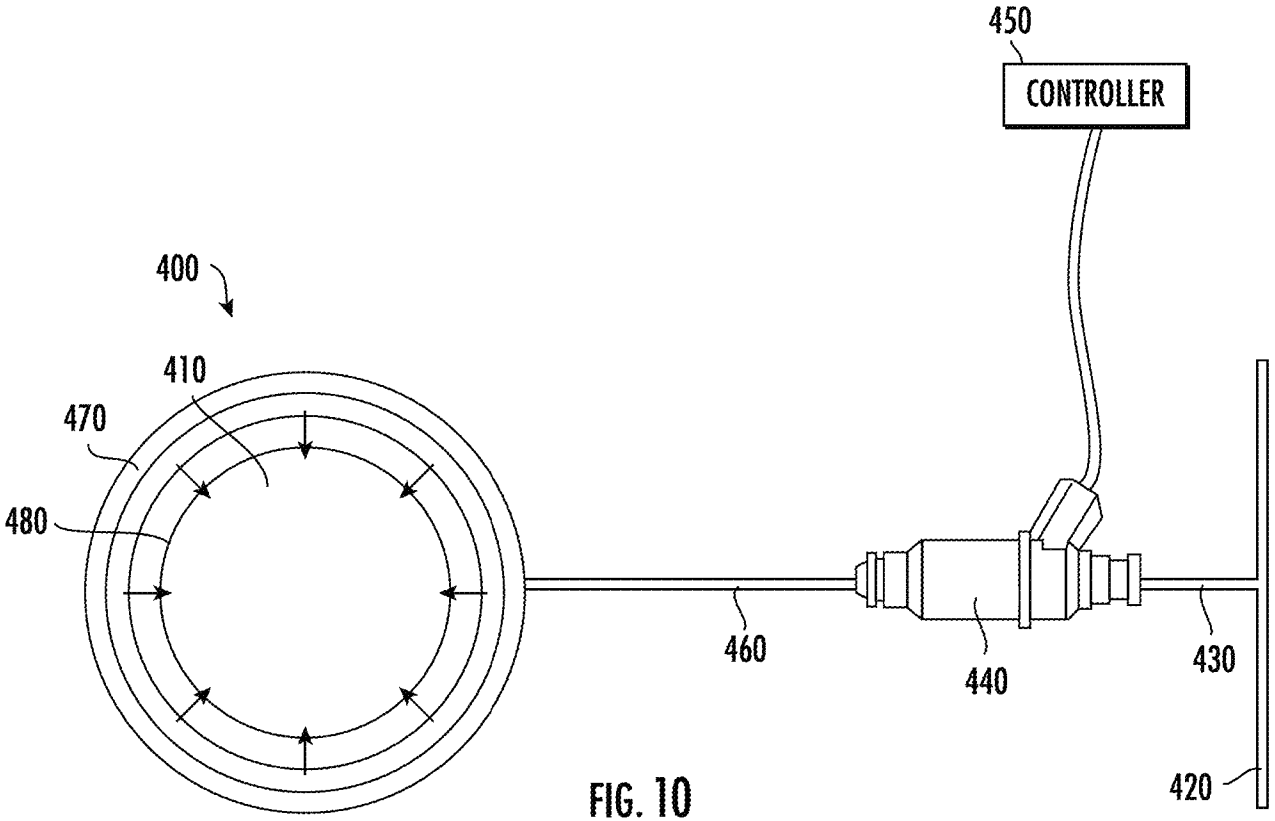
Figure 11:
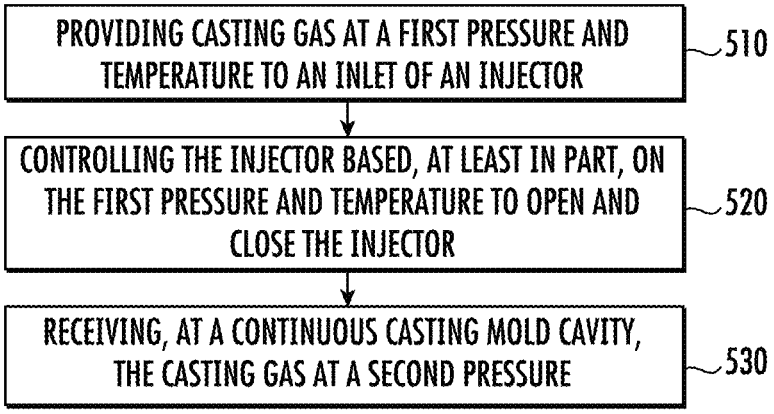

Having thus described certain embodiments of the invention in general terms, reference will now be made to the accompanying drawings, which are not necessarily drawn to scale, and wherein:

FIG. 1 illustrates an example embodiment of a direct chill casting mold according to the prior art;

FIG. 2 illustrates an example of the initial stages of direct chill casting or continuous casting according to an example embodiment of the present disclosure;

FIG. 3 illustrates an example embodiment following the initial stages of direct chill casting according to an example embodiment of the present disclosure;

FIG. 4 illustrates an example embodiment of steady-state direct chill casting according to an example embodiment of the present disclosure;

FIG. 5 illustrates air gap casting of a billet according to an example embodiment of the present disclosure;

FIG. 6 illustrates flow rate through an orifice of an injector according to an example embodiment of the present disclosure;

FIG. 7 illustrates flow rates through an injector according to upstream pressure according to an example embodiment of the present disclosure;

FIG. 8 illustrates back pressure effects on mass flow through an injector according to an example embodiment of the present disclosure;

FIG. 9 illustrates a mold table including a plurality of continuous casting mold cavities according to an example embodiment of the present disclosure; and FIG. 10 illustrates a schematic of the flow of casting gas from a supply line to a continuous casting mold cavity according to an example embodiment of the present disclosure; and FIG. 11 is a flowchart of a method for supplying casting gas to a direct chill casting mold at a well-regulated pressure and volume using fluid injectors according to an example embodiment of the present disclosure.

DETAILED DESCRIPTION

Example embodiments of the present disclosure now will be described more fully hereinafter with reference to the accompanying drawings, in which some, but not all embodiments of the disclosure are shown. Indeed, embodiments described herein take many different forms and should not be construed as limited to the embodiments set forth herein; rather, these embodiments are provided so that this disclosure will satisfy applicable legal requirements. Like numbers refer to like elements throughout.

Embodiments of the present disclosure generally relate to a system, apparatus, and method for supplying casting gas to a direct chill casting mold, and more particularly, to employing an air injector to supply a flow of casting gas at a predetermined pressure and volume to a direct chill casting mold.

Vertical direct chill casting or continuous casting is a process used to produce ingots or billets that have a variety of cross-sectional shapes and sizes for use in a variety of manufacturing applications. The process of direct chill casting begins with a horizontal mold table or mold frame containing one or more vertically oriented molds disposed therein. Each of the molds defines a mold cavity, where the mold cavities are initially closed at the bottom with a starter block to seal the bottom of the mold cavity. Molten metal is introduced to each mold cavity through a metal distribution system to fill the mold cavities. As the molten metal proximate the bottom of the mold, adjacent to the starter block solidifies, the starter block is moved vertically downward along a linear path into a casting pit. The movement of the starter block is caused by a hydraulically lowered platform to which the starter block is attached. The movement of the starter block vertically downward draws the solidified metal from the mold cavity while additional molten metal is introduced into the mold cavity. Once started, this process moves at a relatively steady state for a continuous casting process that forms a metal ingot having a profile defined by the mold cavity, and a height defined by the depth to which the platform and starter block are moved.

During the casting process, the mold itself is cooled to encourage solidification of the metal prior to the metal exiting the mold cavity as the starter block is advanced downwardly, and a cooling fluid is introduced to the surface of the metal proximate the exit of the mold cavity as the metal is cast to draw heat from the cast metal ingot and to solidify the molten metal within the now-solidified shell of the ingot. As the starter block is advanced downward, the cooling fluid is sprayed directly on the ingot to cool the surface and to draw heat from within the core of the ingot.

Also during casting, a casting gas can be supplied through the mold walls to create an air cushion at the mold wall to minimize heat extraction through the mold and to enhance secondary cooling. The direct chill casting process extracts heat through two mechanisms: first through the mold wall as the molten metal contacts the mold wall, and secondly through direct contact (or "direct chill") with a specifically designed water or coolant pattern as the semi-solidified billet exits the mold. Supplying casting gas through the mold wall insulates the mold wall to a degree that substantially reduces mold cooling leaving the majority of the heat extraction to direct water quench. This process leads to a shallow sump and a very thin-shelled, uniform-grained casting with excellent surface smoothness and reduces defects and waste. This casting gas can be supplied such as through a graphite liner of the mold wall. In some cases, the casting gas includes oil which can encourage demolding of the casting as the starter block is lowered into the casting pit.

Embodiments described herein provide an improved method of supplying casting gas to a direct chill casting mold. More specifically, embodiments employ an injector supplied with high pressure casting gas to introduce casting gas to each cavity of a mold. The use of an injector, such as an automotive fuel injector, provides an efficient mechanism for supplying casting gas while being able to control the flow of the casting gas with relative precision. This process is superior to existing needle valve techniques to supply casting gas which limit control but is lower cost, and superior to use of a mass flow controller which can supply casting gas with more precision, but at a significant cost.

FIG. 1 depicts a general illustration of a cross-section of a direct chill casting mold 100 during the continuous casting process. The illustrated mold could be for a round billet or a substantially rectangular ingot, for example. The cooling water spray pattern as described herein is primarily directed to round billet casting. However, embodiments could potentially be used for a substantially rectangular ingot, particularly when the corners of said ingot have some degree of curvature. As shown, the continuous casting mold 105 forms a mold cavity from which the cast part 110 is formed. The casting process begins with the starter block 115 sealing or substantially filling the bottom of the mold cavity against mold walls of the continuous casting mold 105. As the platform 120 moves down along arrow 145 into a casting pit and the cast part begins to solidify at its edges within the mold walls of the continuous casting mold 105, the cast part 110 exits the mold cavity. Metal flows from a pouring trough 125, which in some embodiments includes a heated reservoir or a reservoir fed from a furnace, for example, through thimble 130 into the mold cavity. As shown, the thimble 130 is partially submerged within a molten pool of metal 135 to avoid the oxidation of metal that would occur if fed from above the molten metal pool 135. The solidified metal 140 constitutes the formed cast part, such as an ingot. Flow through the thimble 130 is controlled within the pouring trough 125, such as by a tapered plug fitting within an orifice connecting a cavity of the pouring trough 125 with a flow channel through the thimble 130. Conventionally, the pouring trough 125, thimble 130, and mold cavity/mold walls of the continuous casting mold 105 are held in a fixed relationship from the beginning of the casting operation through the end of the casting operation. Flow of metal through the thimble 130 continues as the platform 120 continues to descend along arrow 145 into the casting pit. When the casting operation is to end, either by the platform being at the bottom of its travel, the metal supply running low, or the cast part reaching the completed size, the flow of metal through the thimble 130 stops, and the thimble assembled on the trough is removed from the molten pool of metal 135 to allow the molten pool to solidify and complete the cast part.

FIG. 2 illustrates an example embodiment of a hot top casting method of the direct chill casting process according to the present disclosure including a continuous casting mold 105, trough 125, and thimble 130 for supplying molten metal from the trough to the cavity of the mold. The illustrated embodiment of FIG. 2 includes a starting position where the tip of the thimble 130 or thimble is positioned proximate the starter block 115 which is supported by the platform 120. The starter block 115 is positioned atop platform 120 and aligned to cooperate with the mold 105 to seal the mold cavity and preclude molten metal 107 from leaking from between the continuous casting mold 105 and the starter block 115. The tip of the thimble 130 or thimble is received into a transition plate 200 that is securely attached to the top of the mold 105, such as by threaded engagement. The transition plate 200 of an example embodiment is secured to the mold 105 by a metal ring that is threaded into a round opening atop the billet mold 105 to hold the transition plate securely to the mold. The mold 105 of an example embodiment is constructed of a metal such as aluminum, while the thimble 130 and transition plate 200 are generally formed of a refractory material that is resilient to heat.

FIG. 2 illustrates the start of a cast with the starter block 115 aligned with the continuous casting mold 105. As the cast starts as shown in FIG. 3, the platform 120 descends with the starter block 115 as molten metal flows through the thimble 130 from the trough 125 and solidifies on the starter block 115 and at the bottom of the mold cavity forming the cast part 140. In this manner, as the starter block 115 descends away from the continuous casting mold 105, the cast part, shown in FIG. 4 as 140, is formed. FIG. 4 illustrates the run-state phase of the casting process or the steady-state portion where the platform 120 descends at a near constant rate with the cast part 140 growing accordingly. FIG. 2 also illustrates spray jets 150, where the spray jets provide a coolant or cooling fluid to the surface of the casting.

Direct chill casting using the hot top casting method of FIGS. 2-4 can employ the use of casting gas to produce a better, more defect-free casting. According to example embodiments described herein, billet mold casting technology for hot-top direct chill casting of aluminum, as shown in FIG. 5, employs a graphite casting surface 210 upon which the initial solidification of the billet being cast occurs. The permeable graphite material allows for flowing both casting gas and casting lubricant if needed (collectively, casting gas) to the casting surface that produces an air-slip casting condition including air gap 220 between the molten metal 107 that is solidifying in the mold cavity and the graphite casting surface 210. The casting gas reduces the friction on the casting surface 210 to prevent sticking and tearing of the freshly solidifying shell of the cast part 140. The casting gas flow further aids in reducing this friction while at the same time providing a thin film of gas between the casting surface and the billet shell which reduces the thermal heat transfer from the molten aluminum to the casting surface. When properly balanced, the introduction of gas and oil produces an as-cast billet with a very smooth surface and very narrow shell thickness as compared to conventionally cast billets. Water or coolant flowing to spray jets 150 from the coolant chamber 155 impinges upon the shell of the cast part 140 and proceeds to flow down the sides of the cast part as shown at 145 to further cool the casting.

The amount of casting gas used during casting is directly related to the surface area of the billet. Balancing the amount of casting gas introduced through the casting surface is difficult. Due to the inherent shrinkage that occurs during the solidification process, the shell of the billet contracts away from the casting surface 210 slightly and can allow the gas to escape out the lower portion of the mold cavity. However, the density of the casting gas is substantially lower than the molten metal, such that any excess casting gas that cannot escape out the lower portion of the mold tends to rise upwards inside the mold cavity and up through the molten metal above the mold in the pouring trough 125 or "hot top" design of the casting system. This air can be problematic and introduce contaminants into the casting. For example, oxide films can form at the top of the casting, and an air gap above the casting can lead to bubbling which can introduce the oxide film into the casting itself. These oxide films are considered to be 'inclusions' which have the potential to create defects in subsequent downstream processed components.

Thus, it is important to supply casting gas at a controlled rate and pressure. Casting gas is typically supplied using independent mass flow controllers for every position on a casting table (i.e., for each billet mold cavity). This architecture is costly on a per-position basis and requires a tremendous amount of room on the casting table to fit the required controllers on the table. Embodiments described herein provide a method of supplying casting gas at a consistent and controllable manner that involves less cost and complexity than current technologies. The fundamentals of sonic flow are employed in development of the embodiments described herein. With sonic flow conditions, mass flow rate is no longer controlled by back pressure of the mold but rather by characteristics of a known orifice size that can be calibrated and verified. Decoupling mass flow from the downstream pressure ensures consistent mass flow over the operating range of the casting gas supply system regardless of the back pressure resulting from variations in the mold position graphite. To operate in the sonic region, supply pressure is increased greater than the critical ratio to ensure downstream pressure does not increase above the critical ratio in operation.

In the field of pneumatics, sonic flow is the most accurate way to characterize flow through an orifice. The pressure ratio is defined as $P_2/P_1$, where $P_2$ is the downstream pressure (after the orifice) and $P_1$ is the upstream/supply pressure (before the orifice). The critical ratio to achieve sonic conditions through an orifice, more commonly referred to as "choked flow" or "choked velocity" is approximately 0.528 or less. In practice, the pressure ratio is calculated with absolute pressures. An example of this is illustrated in FIG. 6 for a theoretical orifice discharge.

Embodiments described herein employ an injector for injecting casting gas to a mold cavity. According to an example embodiment, an automotive direct injection fuel injector can be employed as a low-cost and reliable high pressure solenoid. Supply pressures can be in excess of 2,000 psi (pounds per square inch). The system of example embodiments can be calibrated to determine the required on-time of the injector to deliver the required volume of air per unit time. The injector can then be pulsed multiple times per second at the appropriate duty cycle to achieve the continuous flow required for casting gas.

FIG. 7 illustrates an example embodiment of flow curves. The flow is substantially linear with respect to time. Current control can be used to control the on-time down to the microsecond for fine-tuned control. This plot illustrates the flow characteristics of a tested injector at two different supply pressures with both increasing and decreasing flow. The r^2 value of nearly 1 indicates extremely strong correlation with on time as well as nearly imperceptible valve hysteresis.

Testing has confirmed that the injector tolerance to back pressure variations can be reflected in the plot of FIG. 8. As illustrated, the increase in back pressure ratio to 35% from 5% had at worst a change in flow of less than 1% from nominal. This pressure ratio corresponds to a mold back pressure of more than 100 psig as the supply pressure in this instance was only 300 psi.

Embodiments described herein employ a pulsed flow by cycling an injector to deliver the desired flow of casting gas to the continuous casting mold. With a high ratio of supplied pressure to an inlet of the injector relative to the backpressure at an outlet of the injector, sonic flow is achieved. This ratio can be around 1:2 (downstream to upstream) as noted above. This sonic flow provides a known flow rate of casting gas through the injector, such that the volume of casting gas provided to the continuous casting mold can be precisely controlled through the time the injector is on and the valve open. The known flow rate is based on the pressure differential across the injector and the temperature of the air. Using this known flow rate, the injector is capable of providing pulsed flow to the continuous casting mold. This pulsing can be achieved in example embodiments with a frequency of five Hertz as shown in FIG. 7 with an open duration of the injector varied based on the casting gas flow needs of the mold.

FIG. 9, though not to scale, illustrates an example embodiment of a mold table 300 having twelve mold cavities 310. A valve block 320 is depicted that separately supplies each mold cavity 310 with casting gas via a supply line 330. The twelve injectors can be housed, for example, in valve block 320 such that the casting gas supply can be received at the valve block 320 while the valve block can function as a manifold to distribute the casting gas to each respective injector. The casting gas is plumbed to be supplied to the mold cavity through a mold wall, such as through a graphite casting surface 210 shown in FIG. 5. The casting gas may be distributed evenly around the mold cavity 310 to enter the mold cavity substantially evenly about the perimeter of the mold cavity. This produces the air gap described above.

Air casting in the aluminum industry has largely relied upon either flow control or pressure control. Pressure control is often susceptible to variations in process variables and manufacturing tolerances, such that flow control has become the dominant control scheme used in the industry for producing the air gap within the continuous casting mold. Flow control; however, has one primary drawback. Mass flow is expensive to monitor on multi-strand systems. Numerous solutions attempt to mitigate this issue by sharing meters between multiple mold cavities or positions on the mold table, with 50 mold cavities or more controlled by a single meter in some embodiments to minimize the control and monitoring process costs.

Embodiments described herein employ sonic flow. Sonic flow is a flow region where a large pressure differential, greater than approximately 1:2 (downstream to upstream), is generated across a fixed orifice size. The upstream pressure is controlled at a set pressure. The flow through the orifice of the injector enters the sonic flow region where the velocity through the orifice reaches the speed of sound in the media. At the sonic condition when the Mach number is 1 or greater the downstream pressure wave cannot reach the upstream choke point because the media is traveling at an equal or greater and opposite direction. As a result, mass flow rate becomes a function of upstream pressure and temperature conditions. Mass flow scales linearly with increasing upstream pressure as long as downstream pressure does not exceed the threshold sonic flow differential. After initial mapping the mass flow can be interpreted/calibrated based on time duration and supply conditions (temperature/pressure). In practice, a valve added in line to the control orifice is opened and closed with a given duty cycle and frequency dictating the flow rate through the system. Here, the valve and orifice are both components of the injector, with the valve being generally solenoid controlled with the fixed orifice of the direct injection fuel injector. The proximity of the valve to the orifice (dead volume between) directly impacts the minimum valve open time to minimize impact of the open and close time effects.

The use of a sonic flow enables linear flow control without the need for closed loop control for downstream pressures less than half of the supply pressure. With increased supply pressure to the injectors, downstream pressure can be greater than traditional control systems. Average flow rates into the mold cavity (e.g., through the porous media such as a graphite liner) is controlled via pulses of flow at various pulse widths. Pulses in the supply to the mold has the effect of increasing velocity and pressure around the mold temporarily to better distribute air and oil of the casting gas within the mold bodies. This effect is important as while higher pressure behind a porous media will help to normalize the flow around the surface area, the higher pressure cannot be sustained with the densities/porosities available, such that the pressure spikes generate a similar effect while maintaining proper flow rate.

Embodiments adopt pulse technology to deliver casting gas in the form of air, an air/oil mixture, or air and oil in separate flows. When used with oil alone, the sonic flow conditions would not apply, and the operation is flow rate limited such as in an automotive fuel injection application. In an embodiment used to deliver casting gas as an air and oil mixture with the pulsing valve design the air/oil ratio can be set as a function of total air flow thereby delivering only the required oil on a per mold basis to reduce waste oil.

An example embodiment described herein employs an injector that includes an inward opening direct drive solenoid valve that ensures the volume and pressure behind the controlling orifice is as free flowing as possible, thereby limiting the time per cycle in the non-linear region. According to such an embodiment, the valve has an opening time of between 500 and 1,000 microseconds. In order to reduce errors and maintain linear flow characteristics, the minimum open time per cycle is selected to be greater than the opening time of the valve. This offset generates the characteristic flow equation for the valve of the form Flow=mx+b, where m is the slope of the characteristic curve, x is the on time of the valve in seconds (e.g., microseconds, milliseconds, or other time unit), and b is the valve offset associated with the minimum valve open time. Control of the pulse flow can be performed with a hit/hold drive circuit on a direct acting solenoid valve as in this application, with various frequency and duty cycle demands. For example employing a 5 Hz frequency for a balance of a cycle count and consistency of flow to the mold.

Embodiments described herein can employ open loop control or closed loop control. Open loop control for supplying casting gas to a mold cavity can rely upon pre-mapped injector strategies that are developed based on injector-specific geometry. Closed loop control can be employed using feedback from the casting gas downstream of the injector, such as using temperature and/or pressure, for example.

FIG. 10 illustrates a simplified schematic of a system for employing an injector, comprising a solenoid operated valve and a fixed size orifice, for introducing casting gas to a mold. As shown, the system 400 includes a mold cavity 410 that can be one of any number of mold cavities of a mold table. The system includes a casting gas supply manifold 420 that supplies casting gas at a high pressure (e.g., up to 1,000 psi) to supply line 430 which is the input for the injector 440. The injector 440 can include an automotive style fuel injector adapted for use with casting gas in lieu of automotive fuel (e.g., gasoline, diesel, ethanol, etc.). The operation of the injector 440 is controlled by controller 450 which is in electrical communication with the injector 440 to control the opening/closing of the valve of the solenoid and the duration of each pulse. Casting gas is supplied from the fuel injector 440 to the mold cavity 410, via a post injector supply line 460 such as through a channel 470 disposed around the mold cavity with passages to allow the casting gas to flow through the mold wall 480, such as through a porous graphite liner of the mold wall.

FIG. 11 is a flowchart for supplying casting gas to a direct chill casting mold at a well-regulated pressure and volume using fluid injectors. As shown, casting gas is provided at a first pressure and temperature to an inlet of an injector at 510. The injector is controlled at 520 according to the first pressure and temperature to open and close the injector. A continuous casting mold cavity receives casting gas at a second pressure from the injector at 530, where the casting gas is provided to the continuous casting mold cavity through a porous graphite liner of the continuous casting mold.

Blocks of the flowchart support combinations of means for performing the specified functions and combinations of operations for performing the specified functions. It will also be understood that one or more blocks of the flowcharts, and combinations of blocks in the flowcharts, can be implemented by various aspects of venting of casting gas from a direct chill casting mold as described above.

In some embodiments, certain ones of the operations above are modified or further amplified. Furthermore, in some embodiments, additional optional operations are included. Modifications, additions, or amplifications to the operations above of an example embodiment are performed in any order and in any combination that facilitates the venting of casting gas as described herein.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A system for supplying casting gas to a continuous casting mold, the system comprising:

a continuous casting mold cavity;

a casting gas supply line;

an automotive fuel injector receiving casting gas from the casting gas supply line; and a post fuel injector casting gas supply line, wherein casting gas is supplied via the casting gas supply line at a first pressure, wherein the automotive fuel injector is pulsed to deliver casting gas at a second pressure to the post fuel injector casting gas supply line, wherein a ratio of the first pressure to the second pressure is about two-to-one, wherein a controller controls the automotive fuel injector to supply casting gas via the post fuel injector casting gas supply line to the continuous casting mold cavity.

2. The system of claim 1, wherein the automotive fuel injector comprises an electronically controlled injector.

3. The system of claim 1, further comprising a channel within the continuous casting mold, wherein the post fuel injector casting gas supply line provides the casting gas to the channel which distributes the casting gas around the continuous casting mold cavity.

4. The system of claim 3, wherein the continuous casting mold cavity comprises a porous graphite mold wall, wherein the casting gas is provided to the continuous casting mold cavity through the porous graphite mold wall.

5. The system of claim 1, wherein the casting gas comprises at least air and a lubricant.

6. The system of claim 5, wherein the automotive fuel injector is driven by the controller using pulse width modulation.

7. The system of claim 1, wherein the automotive fuel injector comprises a solenoid operated valve to open and close the automotive fuel injector, wherein in an open condition the automotive fuel injector permits flow of casting gas from the casting gas supply line to the post fuel injector casting gas supply line.

8. The system of claim 7, wherein the automotive fuel injector comprises a fixed orifice for supplying casting gas to the post fuel injector casting gas supply line.

9. The system of claim 1, wherein the automotive fuel injector is controlled using an open loop control strategy.

10. The system of claim 9, wherein the automotive fuel injector is controlled according to a temperature and a pressure of the casting gas at the casting gas supply line.

11. A system for supplying casting gas to a continuous casting mold, the system comprising:

a controller;

at least one continuous casting mold cavity;

a casting gas manifold; and at least one automotive style fuel injector wherein each of the at least one automotive style fuel injector is associated with a respective one of the at least one continuous casting mold cavity, wherein the at least one automotive style fuel injector receives casting gas from the casting gas manifold at a first pressure and is controlled by the controller to supply casting gas to the respective one of the at least one continuous casting mold cavity at a second pressure, wherein a ratio of the first pressure to the second pressure is about two-to-one.

12. The system of claim 11, wherein the at least one automotive style fuel injector comprises a solenoid operated valve to open and close the at least one automotive style fuel injector, wherein in an open condition the at least one automotive style fuel injector permits flow of casting gas from a casting gas supply line to a post injector casting gas supply line.

13. The system of claim 12, wherein the at least one automotive style fuel injector comprises a fixed orifice for supplying casting gas to the post injector casting gas supply line.

14. The system of claim 13, wherein the at least one automotive style fuel injector is driven by the controller using pulse width modulation.

15. The system of claim 12, further comprising a channel within the continuous casting mold, wherein the post injector casting gas supply line provides the casting gas to the channel which distributes the casting gas around the at least one continuous casting mold cavity.

16. The system of claim 15, wherein the at least one continuous casting mold cavity comprises a porous graphite mold wall, wherein the casting gas is provided to the at least one continuous casting mold cavity through the porous graphite mold wall.

17. The system of claim 11, wherein the at least one automotive style fuel injector is controlled using an open loop control strategy.

18. The system of claim 17, wherein the at least one automotive style fuel injector is controlled according to a temperature and a pressure of the casting gas at a casting gas supply line.

19. A method for supplying casting gas to a continuous casting mold, the method comprising:

providing casting gas at a first pressure and temperature to an inlet of an automotive fuel injector;

controlling the automotive fuel injector based, at least in part, on the first pressure and temperature, to open and close the automotive fuel injector; and receiving, at a continuous casting mold cavity, the casting gas at a second pressure, wherein the casting gas is provided to the continuous casting mold cavity through a porous graphite liner of the continuous casting mold, and wherein a ratio of the first pressure to the second pressure is about two-to-one.

20. The method of claim 19, wherein controlling the automotive fuel injector further comprises controlling the automotive fuel injector via pulse width modulation.

* * * * *